US009339072B2

(12) United States Patent
Kenna

(10) Patent No.: US 9,339,072 B2
(45) Date of Patent: May 17, 2016

(54) HAIR EXTENSIONS AND METHOD OF ATTACHMENT

(76) Inventor: Lisa Kenna, Boca Raton, FL (US)

( * ) Notice: Subject to any disclaimer, the term of this patent is extended or adjusted under 35 U.S.C. 154(b) by 882 days.

(21) Appl. No.: 12/317,810

(22) Filed: Dec. 29, 2008

(65) Prior Publication Data

US 2009/0120451 A1 May 14, 2009

Related U.S. Application Data

(63) Continuation-in-part of application No. PCT/US2006/036890, filed on Sep. 23, 2006.

(60) Provisional application No. 61/010,411, filed on Jan. 8, 2008.

(51) Int. Cl.
*A41G 5/00* (2006.01)
*A41G 3/00* (2006.01)

(52) U.S. Cl.
CPC ..... *A41G 5/008* (2013.01); *A41G 5/0033* (2013.01); *A41G 5/004* (2013.01); *A41G 5/0053* (2013.01)

(58) Field of Classification Search
CPC ..... A41G 5/008; A41G 5/0053; A41G 5/004; A41G 5/0033; A41G 5/00; A41G 3/00; A41G 3/0025; A41G 3/0008
USPC ..... 132/53, 201, 54–56
See application file for complete search history.

(56) References Cited

U.S. PATENT DOCUMENTS 3,835,868 A * 9/1974 Heck ..... 132/201
4,934,387 A * 6/1990 Megna ..... 132/201
5,413,124 A * 5/1995 Incando ..... 132/201
5,722,434 A * 3/1998 Walker ..... 132/53
5,868,145 A * 2/1999 Spann ..... 132/201
5,937,867 A 8/1999 Williams
7,533,676 B2 * 5/2009 Sthair ..... 132/201
2001/0037813 A1 * 11/2001 Ra ..... 132/53
2004/0011371 A1 * 1/2004 Harrison ..... 132/201
2005/0092342 A1 * 5/2005 Sthair ..... A41G 5/008 132/201
2006/0144413 A1 * 7/2006 Yoneda et al. ..... 132/53
2006/0169296 A1 * 8/2006 Gill ..... A41G 5/004 132/53
2006/0169297 A1 * 8/2006 Gill et al. ..... 132/201
2007/0157944 A1 * 7/2007 Catron et al. ..... 132/201
2011/0005544 A1 1/2011 Lane
2011/0094530 A1 * 4/2011 Sedillo-Beadell ..... A41G 5/008 132/201
2013/0133680 A1 * 5/2013 Wang ..... A41G 5/008 132/201

* cited by examiner

*Primary Examiner* — Robyn Doan
(74) *Attorney, Agent, or Firm* — Daniel C. Crilly; Gray Robinson, P.A.

(57) ABSTRACT

A unique human or synthetic fiber hair extension and method are disclosed. One embodiment of the human or synthetic fiber hair extensions come packaged with double sided tape attached to both sides of the hair extension, with the weft and human or synthetic fiber hair attached between the two pieces of tape. The double sided tape is covered with a tape cover or liner on both sides of the extensions. First, the human or synthetic fiber hair extension is positioned for correct placement below the horizontal part line, the liner is removed form the bottom side of the hair extension and the human or synthetic fiber hair extension is secured by pressing into place. The second piece of double sided tape which is attached to the second side of the human or synthetic fiber hair extension and facing up has the liner removed and is then covered with a layer of the users's natural hair, which taken from the clipped area above the part. This creates a sandwich-like effect attachment of the human or synthetic fiber hair with the user's hair. Also shown is a flow chart and various application methods aiding the stylist in analyzing and applying extensions to the users head.

21 Claims, 17 Drawing Sheets

HAIR EXTENSIONS AND METHOD OF ATTACHMENT

PRIORITY

This application is a continuation in part and claims priority from PCT International application No: PCT/US2006/036890 with International filing date Sep. 23, 2006 and priority date of Jun. 29, 2006 now abandoned. This application claims priority from Provisional Application for Patent Ser. No. 61/010,411 filing date Jan. 8, 2008.

TECHNICAL FIELD

The present version of these embodiments relate generally to the field of hair extensions and method for application of hair extensions for enhancing a users natural hair.

BACKGROUND

This application relates to hair extensions and method of attachment. More particularly to hair extensions where synthetic fibre hair blends can be heat styled with hot rollers, flat ironed or blow dried like a users natural hair unlike any other synthetic hair on the market. The fibre hair blends can also be put into a kit.

These human or synthetic fibre hair extensions provide great value to the consumer by providing a reasonably priced high quality human or synthetic fibre hair with human hair quality and many colors and color combinations. Other high temperature synthetic fibre hair currently on the market does not provide as wide a selection of color choices as the applicant. Most products on the market have only limited colors with extensions no longer than 16". Applicants will be providing up to 10 colors with 6 color combinations being reversible and 18-20" in length for at least 16 color possibilities. Various additional colors and color combinations may be added in the future. The human hair products are reversible also and come at least 20 colors and blends. No other products on the market provides a two color or reversible extension where there is one color on one side and a second color on the second side. This two sided color or reversible color will give an added value to the consumers where they receive two colors for the price of one.

Many women especially those that are post menopausal can experience hair thinning and loss. Applicants human or synthetic fibre hair extensions provide an affordable alternative without the use of potentially dangerous hair growth drugs or chemicals.

Applicant's product is the first hair extension kit made with human or synthetic fibre heat activated hair. The kits can contain 18"-20"' long hair with double sided ¾" medical grade tape applied to the extensions which are approximately 4" wide. Obviously other lengths of hair, widths of tape and of hair extensions are anticipated. Also included in the kit can be a bottle of adhesive remover and a "before and after" proprietary clarifying shampoo. The shampoo is exclusive to applicants and recommended for use before the application of the hair extensions to remove oils from the natural hair and after removal of the extensions to remove adhesive and solvent (remover). The kit can also contain a CD-rom with an instructional video, printed application instructions containing styling pages showing different applications and styles that are possible.

Applicant's will be providing different levels of product depending upon the users need. It is anticipated that there will be a home kit for those who wish to install the extensions themselves and also packages and kitting that can be installed by professional hair stylists.

An additional kit can also contain replacement tape if a user wishes to remove the human or synthetic fibre hair extensions and use them again at a later date or if repositioning of existing extensions is desired. This kit could include the adhesive remover, shampoo, new tapes and instructions on how to re-apply the tapes to re-use the extensions. While the shampoo should be used in the natural hair before application of the human or synthetic fibre hair extensions, it can also be used to clean the adhesive remover from the human or synthetic fibre hair extensions before re-use.

The extensions can have one color or solid color of hair on both sides or a corresponding but different color on each side providing a reversible color effect. Alternatively, these hair extensions can have a blended color on both sides of the extensions or have a darker and lighter color on each side of the extension allowing a high light or low light type of application. When, for example, the dark side is applied out from the head, the strands of the light colored hair would show through from the side against the head and vice versa for a highlight and low light effect.

The highlight or low light kits can have human or synthetic fibre hair extensions with a lesser width, for example 2" wide and 18"-20" long and can also be provided with a weft or seam less. While the weft less or seam less human or synthetic fibre hair extensions are better able to be hidden in the users' natural hair, they are more fragile and best suited for application to the area on the top of the head as highlight pieces. Complete kits of coordinating colors can also be sold having the same color, blended color, co-ordinating color or some combination of colors for highlights, low lights or multi dimensional hair colors.

The applicant's have a uniquely blended color system in that the colors blend with each other up or down one or two levels in most cases, which enhances the color dimension of one's hair. These blended color options create unique color blends when used together, for example, using two or more individual kits together can create an entirely new color blend. This also eliminates the need in most cases for an exact match to the users hair. This choice of colors can also provide a highlight or low light effect without bleach or coloring which can damage the natural hair. Obviously, the extensions can be reversed to provide custom color choices.

The applicant's synthetic fibre hair extensions can be provided in a straight or wavy configuration. They benefit from the advantage that they can hold the last heat activation that was performed or have a memory. For example, if a synthetic fibre hair extension had hot rollers placed in the extension, the hair would maintain this wavy configuration even after washing and until it is subject to a new heat activation such as straightening.

Generally these human or synthetic fibre hairs are sewn together at a sewn end or weft. In one embodiment the weft is placed in between and located in the middle of the two pieces of double sided tape. In an alternative embodiment, the hair is placed between the two pieces and the weft placed above the two pieces of double sided tape. The weft is then cut off, such that the weft is removed and no weft is visible. The hair remains secured between the two pieces of double sided tape. Other methods of securing the hair together before removing the weft are also disclosed.

These weft less or as commonly known in the industry as "seam less", human or synthetic fibre hair extensions can be used in the same manner as the human or synthetic fibre hair extensions which contain a weft. The advantage to the seam less extensions is that it lessens the likelihood of seeing or feeling the extensions in your hair with the weft removed. No other product on the market uses this weft less application done in this manner on human or synthetic fibre hair, all other weft or seam less extensions are used only on human hair with a different tape system.

Both the weft and weft less (seam less) human or synthetic fibre hair extensions can be provided with double sided tape tinted or colored to match or co-ordinate with the color of the fibre hair extension. Up until now, no other tape adhesive has ever been tinted to match the color of the hair extension. Background art currently uses a clear tape which may be visible in darker hair and uses a different tape application method and smaller tape size. To produce this tinted tape for hair extensions, clear tape is run through a rotary die press printing machine where ink is applied by rollers to the tape. Several passes may be required to get the correct shade or tint that matches or corresponds to the color of the hair extensions.

The application of these hair extensions is relatively simple to perform and can be applied without the use of messy, many times difficult to use liquids or chemicals. These extensions can be applied and removed in minutes and there is a significant reduction of damage to the users natural hair if used according to the directions as compared to other products on the market. Once applied, extensions can be kept in place for up to two months or more. The hair extensions can be washed, conditioned and styled with a flat iron, hot rollers or blown dry like the users' natural hair.

Hair extensions have been used in the hair styling industry for many years. Users and stylists have made use of products to enhance the length of a users hair or to add body or bulk to thinning hair. Many of the products on the market are made from synthetic hair, but these products up until now have not been able to be heat styled with a blow dryer, flat iron or hot rollers unlike the applicant's human or synthetic fibre hair which can be heat styled. Prior synthetic products would melt when a heat source was used.

Another background art hair extension product uses clip on extensions. These clip on extensions are available for the home or professional market. These extensions are not semi-permanent and must be re-applied daily, can fall out unexpectedly and are only feasible if the users hair is thick enough to cover the clip and can damage natural hair.

Many of the products on the market require the use of a liquid adhesive. This generally prevents the average consumer from the application of these extensions. Sewn in extensions, braided style extensions and heat applied extensions can be as damaging to natural hair as liquid adhesive applied with latex glue.

Some of the products on the market require the tape portion to be applied to the users' hair first and then the hair extensions to be placed on the already applied tape portion. Applicant's product and method is significantly easier to apply by the average consumer and thus is more secure for a longer period of time.

Other background methods use pre-tipped hair which must be tediously applied, uses chemicals and heat for application and removal and can cause significant damage to natural hair.

For the foregoing reasons, there is a need for a human or synthetic fibre hair extension that can be applied and removed relatively easily. There is a need to have human or synthetic fibre hair extensions that will match the color of the users' hair. There is also a need to have human or synthetic fibre hair extensions that can be one color on one side and a related color or non-related color on the other side depending on the users' preference. There is also a need to have human or synthetic fibre hair extensions that can provide a high light or low light effect to a users' hair. There is a need to have a tinted tape matching the human or synthetic fibre hair extensions and better blend with the users natural hair.

SUMMARY DISCLOSURE

In view of the foregoing disadvantages inherent in the area of hair extensions there is a need for a new style of human or synthetic fibre hair extensions that are semi-permanent.

A first objective of these embodiments is to provide hair extensions that can be relatively easily applied or attached and removed.

Another objective of these embodiments is to provide hair extensions that will match the users' hair, or not match, as the user may choose.

It is yet another objective of these embodiments to provide a synthetic hair extension that can be blow dried, curled and able to be styled using a flat iron, hot roller and other styling tools used in the industry.

It is a still further objective of these embodiments to provide hair extensions that have an attachment means that blends with the hair extension or the users' hair.

An additional objective of these embodiments is to provide hair extensions that can be applied and maintained for a relatively long period of time.

Another objective of these embodiments is to provide complete kits to apply or re-apply the human or synthetic fibre hair extensions.

Another objective of these embodiments is to provide an affordable product that is simple to install and remove with little likelihood of damage to the natural hair.

An additional objective of these embodiments is to provide a product that is almost undetectable in a user's hair and is affordable at all levels of users.

These together with other objectives of these embodiments, along with various features of novelty which characterize these embodiments, are pointed out with particularity in the remainder of this application. For a better understanding of these embodiments, the operating advantages and the specific objects attained by the uses, reference should be had to the accompanying drawings and descriptive matter in which there is illustrated a preferred embodiment.

DETAILED DESCRIPTION

Figure 1:
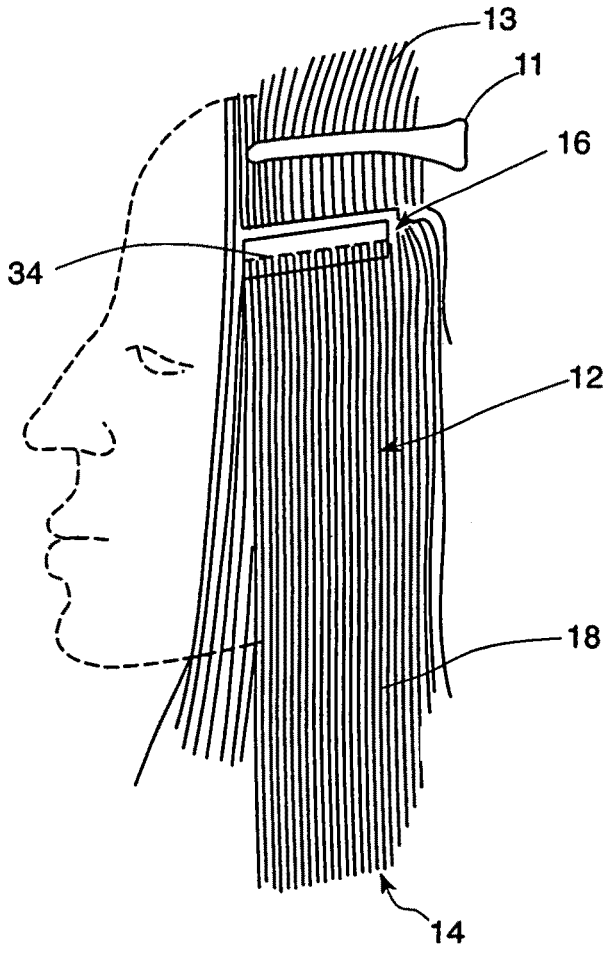
FIG. 1 shows a side view of one embodiment of the human or synthetic fibre hair extension affixed to a user's head.

Referring to the drawings in detail wherein like elements are indicated by like numerals, there is shown in FIG. 1 one embodiment of the human or synthetic fibre hair extension 12 affixed to a user's head. The hair extension 12 has a fixed end 16 which is attached to the users' hair along a part line. The hair extension 12 has a free end 14 in which hair 18 hangs freely at a user desired length. A preferred length of the hair is approximately 18 to 20 inches long. Obviously the hair extensions 12 can be cut or styled if a shorter length is desired.

Hair 18 is preferably manufactured from a polyester, one that is capable of being styled with a blow drier, flat iron, hot rollers, or other heat appliances and behaves much like natural hair. Hair 18 can also be a human or synthetic blend.

Figure 2:
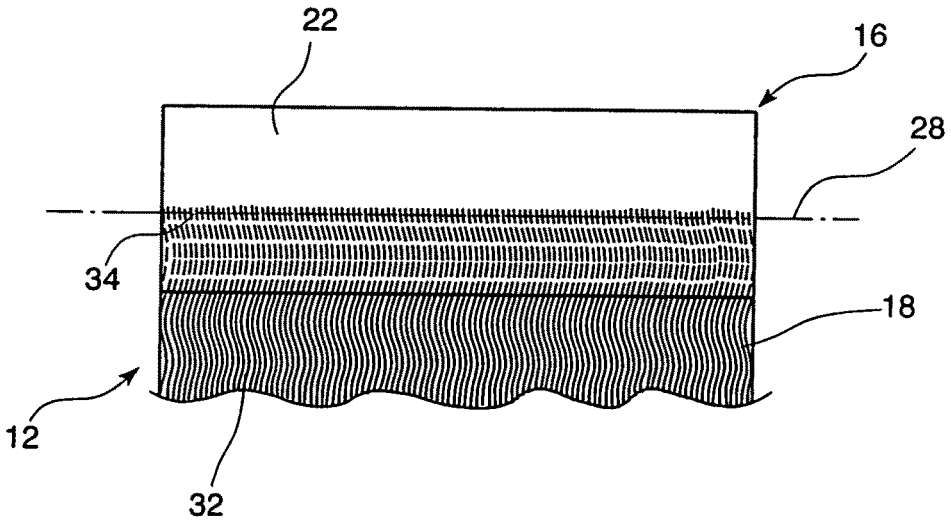
FIG. 2 shows a side view one embodiment of the fixed end of the human or synthetic fibre hair extension.

FIG. 2 shows a detailed view of the fixed end 16. The hair 18 weft 34 is attached to the second tape 22 along a mid-line 28. The hair 18 is secured between the second tape 22 and the first tape 20, not shown. A preferred length of the first and second tapes 20,22 and hair extension 12 is approximately 1.5-4 inches. A preferred width is ¾" wide, but other widths may be functional. Obviously the length of hair 18 can be cut depending upon the users' preference. The first tape 20 and second tape 22 should be of a thickness that is relatively thin such that it is relatively pliable and soft and cannot be felt by the wearer.

The first and second tapes 20,22 can also have "tabs" (not shown) to ease the removal of the first and second covers 24, 26. The tabs can be extended backing so that the user can grasp the covers 24, 26 easier and remove. Alternatively, the covers 24, 26 can be scored such that the user can fold the tapes 20, 22 to ease the removal of the covers 24, 26.

Figure 3:
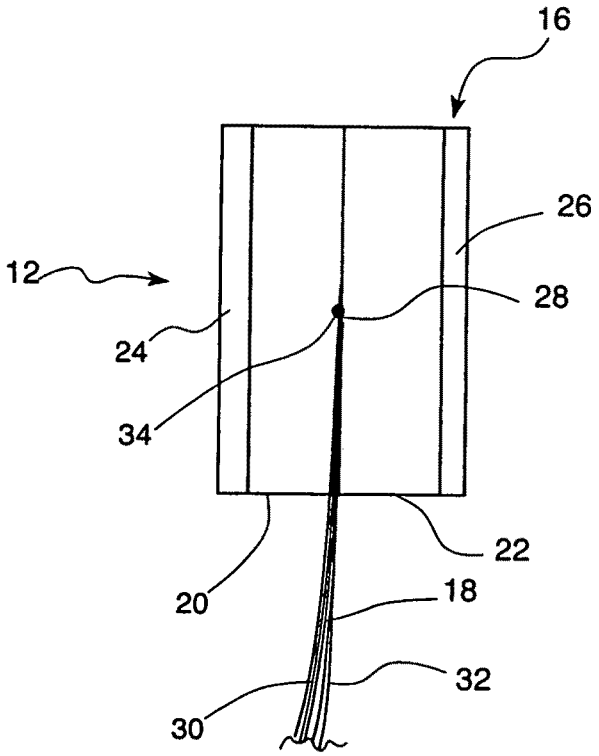
FIG. 3 shows an exaggerated end view of one embodiment of the fixed end of the human or synthetic fibre hair extension.

FIG. 3 shows an end view of the fixed end 16. Here it can be seen that the hair 18 is secured between the first tape 20 and the second tape 22 at the mid-line 28. The mid-line 28 is about halfway between the top and bottom edges of the first tape 20 and second tape 22. The first tape 20 is a piece of double sided tape. To assemble the hair extension 12 requires the removal of a cover or liner (not shown) from one side of the first tape 20 and securing the hair 18 at the mid-line 28. A cover or liner (not shown) is removed from one side of the second tape 22 and the exposed side is secured to the hair 18 and in a corresponding location to the first tape 20.

A preferred width of the first and second tape is approximately ¾ inches wide. Obviously other widths may be functional, but it has been determined that a width of ¾ inches provides the best extended retention ability while still being able to be hidden in the users' natural hair.

Attached to the other side of the first tape 20 is first cover or liner 24. Attached to the other side of second tape 22 is second cover or liner 26. The covers 24, 26 are removed and discarded to attach the hair extension 12 to the users' hair.

The hair 18 can show a first color 46 on the first side 30 and a second color 48 on the second side 32. This would allow a user to secure the hair extension 12 with either the first side 30 or second side 32 for view depending on the effect that was desired. The first and second sides 30, 32 can be corresponding colors or much different colors. This provides more options for the user. It may be desirable to have a color that matches the users hair or one that is slightly different to achieve a different look or a color that is much different than the users hair color.

First tape 20 can also correspond to the first color 46 of the hair 18 on the first side 30. Likewise, second tape 22 can correspond to the second color 48 of the hair 18 on the second side 32. The matching of the tapes 20,22 to the sides 30,32 of the hair 18 helps to hide the fixed end 16 of the hair extensions 12 when attached to the natural hair 13 of the user.

In one embodiment, the first tape 20 corresponds to the color of the hair 18 first side 30 and second tape 22 corresponds to the color of the hair 18 second side 32. Alternative embodiments have the first tape 20 and second tape 22 made from a clear double sided tape which also aids to hide the fixed end 16 of the hair extension 12.

Figure 4:
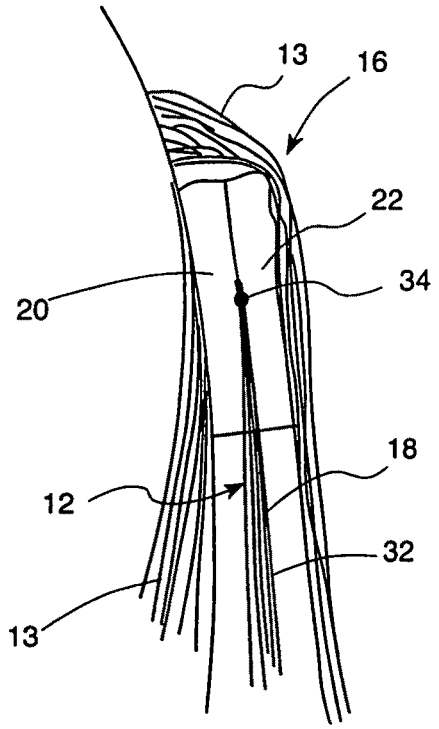
FIG. 4 shows an exaggerated end view of one embodiment of the fixed end of the human or synthetic fibre hair extension attached to a user's head.

FIG. 4 is an exaggerated view of the fixed end 16 of the hair extension 12 attached to a users' natural hair 13. To attach the hair extension 12 the user should shampoo first with a clarifying shampoo that removes oils and other residue that may adversely effect the attachment of the hair extensions 12. Once the hair is dried, the user makes a part line in the natural hair 13 and secures the natural hair 13 with, for example, a hair clip 11, FIG. 1. The user than removes the first cover or liner 24 and places the first tape 20 onto the users' hair 13 below the part line. The second cover or liner 26 is then removed and discarded and the users' hair that had been retained by the hair clip 11 is released to fall naturally over the second tape 22. After the hair falls naturally onto the second tape 22 it can be pressed to the fixed end 16 of the hair extension 12 and the hair extension 12 is then secured to the users' natural hair 13.

Figure 5:
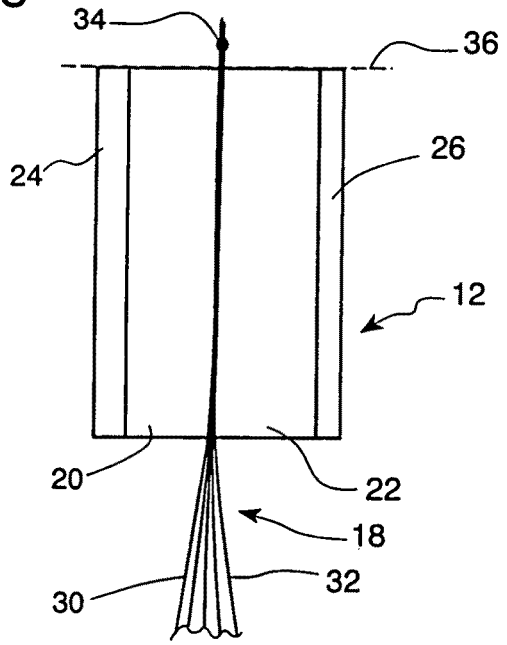
FIG. 5 shows an exaggerated end view of another embodiment of the human or synthetic fibre hair extensions.

FIG. 5 shows another embodiment of the human or synthetic fibre hair extensions 12 where the sewn end or weft 34 is placed above the first and second tapes, 20,22 and then cut off at the cut line 36 along with a small length of human or synthetic fibre hair. This allows the use of the human or synthetic fibre hair extensions 12 in places on a users' head that may be more visible. This embodiment may also be more useful in hiding hair extensions 12 on the side of a users' head because the weft 34 is not present.

Figure 6:
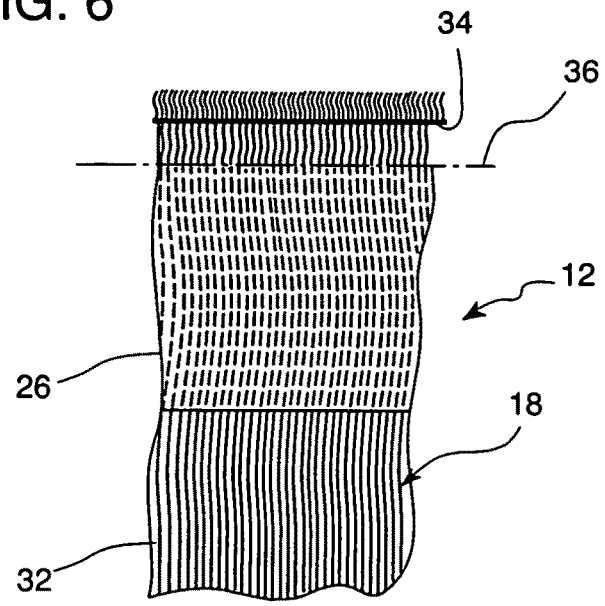
FIG. 6 shows an exaggerated side view of another embodiment of the human or synthetic fibre hair extensions.

FIG. 6 shows a side view of this alternative embodiment in FIG. 5 of the hair extension 12 where the weft or sewn end 34 extends beyond the first and second tape 20,22 and the weft 34 and small portion of human or synthetic fibre hair is cut off at the cut line 36 providing better concealment of the human or synthetic fibre hair extensions 12 in the users' natural hair 13.

To remove the hair extension 12 it is suggested the user to begin with the hair extension highest on the head. The natural hair is parted and the upper hair is clipped up. The solvent (not shown) is then sprayed onto the second tape 22 and the first tape 20 or both above and below the human or synthetic fibre hair extensions 12. The solvent is then rubbed into the adhesive on tapes 20,22 and the hair extension 12 lifted with a rat tail comb. The natural hair is then removed from the second tape 22. The natural hair attached to the first tape 20 is likewise gently removed and the hair extension 12 removed from the users' head. The clarifying shampoo can then be used to wash the natural hair to remove the solvent and prepare the natural hair for re-application of the hair extensions 12 if desired.

Replacement first and second tapes 20, 22 (not shown) can then have hair 18 sewn end or weft 34 placed on the mid-line 28 of new first tape 20 after removal of a cover or liner (not shown) and new second tape 22 cover or liner (not shown) is then removed and the sewn end 34 is then secured to the new second tape 22 at the mid-line 28. Replacement first and second tapes 20, 22 can be used to replace or enhance attachment of the hair extensions 12.

Figure 7:
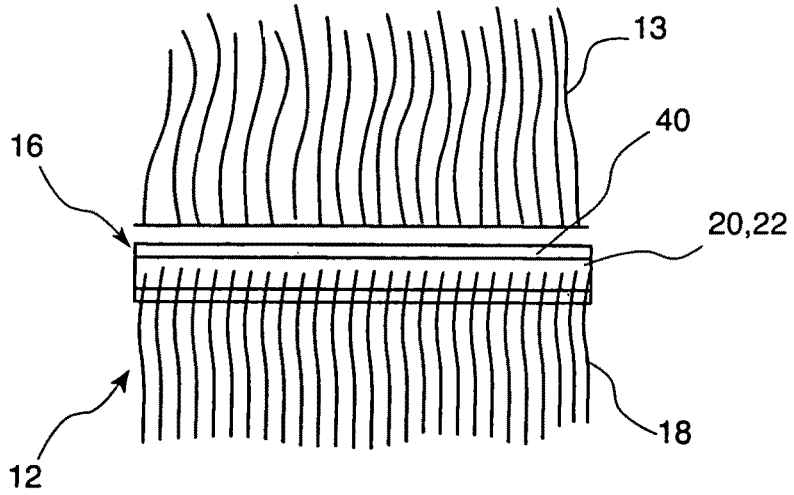
FIG. 7 shows an exaggerated view of another embodiment of the human or synthetic fibre hair extensions with the addition of a third tape for use in thicker natural hair applications.
Figure 8:
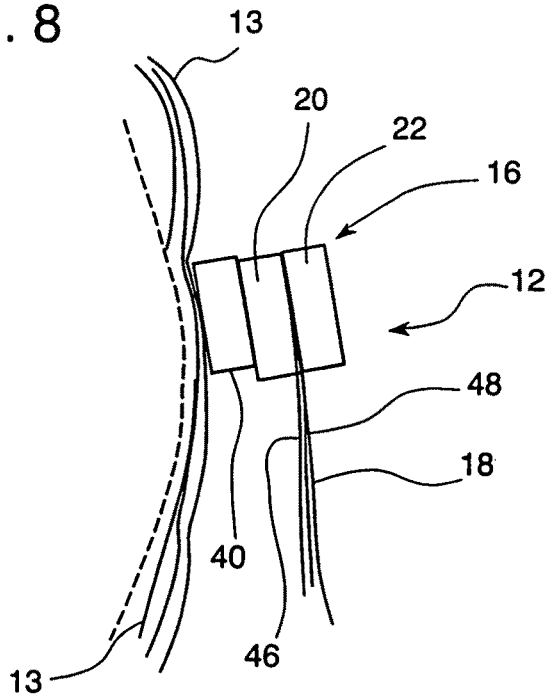
FIG. 8 shows an exaggerated side view of the embodiments shown in FIG. 7.

FIG. 7 shows another embodiment of hair extension 12. This embodiment can be useful in user's that have thick natural hair 13. As shown in FIG. 8, a third tape 40 is affixed to the natural hair 13 at a part line. This third tape 40 has a cover (not shown) that is removed and the third tape 40 is attached to the natural hair 13, FIG. 8. A second cover (not shown) is removed and the hair extension 12 is affixed to the third tape 40. The first cover (not shown) of first tape 20 hair extension 12 is removed and hair extension 12 is placed or secured to the third tape 40. The second cover (not shown) of second tape 22 hair extension 12 is removed and the natural hair 13 above the part line is secured to second tape 22.

This approach works well with users' who have thick hair and provides additional securing of the hair extension 12 to the users' natural hair 13.

Figure 9:
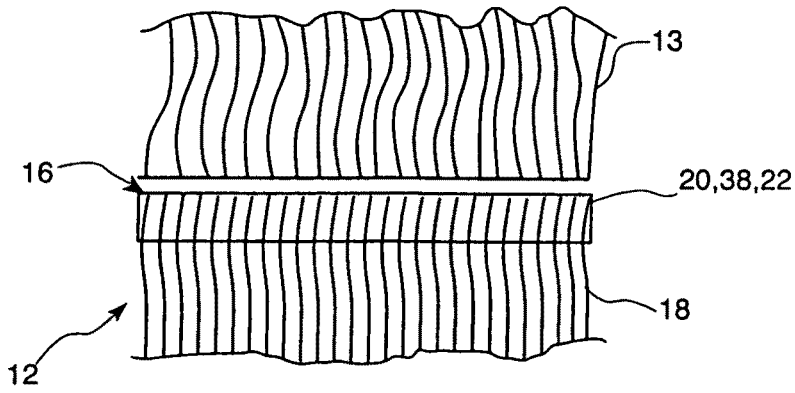
FIG. 9 shows an exaggerated view of another embodiment of human or synthetic fibre hair extensions with a netted backing affixed to the hair and the backing located between first and second tapes.
Figure 10:
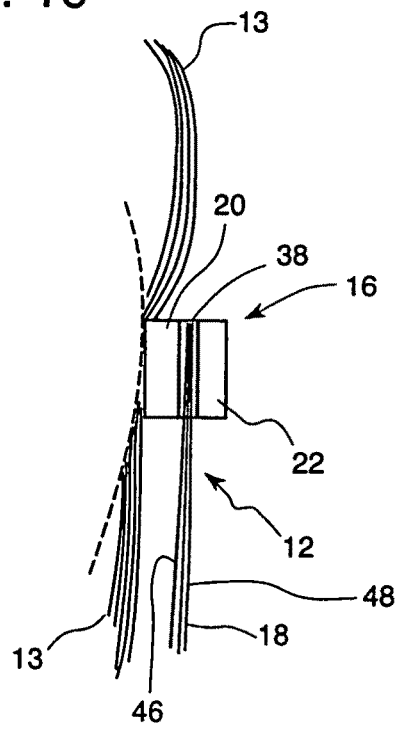
FIG. 10 show an exaggerated side view of the embodiments of FIG. 9.

FIG. 9 shows another embodiment of hair extension 12 secured to a users' natural hair 13. FIG. 10 shows an exaggerated side view of these embodiments. In this embodiment, the hair 18 is secured to a netted backing 38. The netted backing 38 and hair 18 are then sandwiched between first tape 20 and second tape 22. This netted backing 38 helps secure the hair 18. This embodiment of hair extension 12 is attached to the natural hair 13 as has been previously described.

Figure 11:
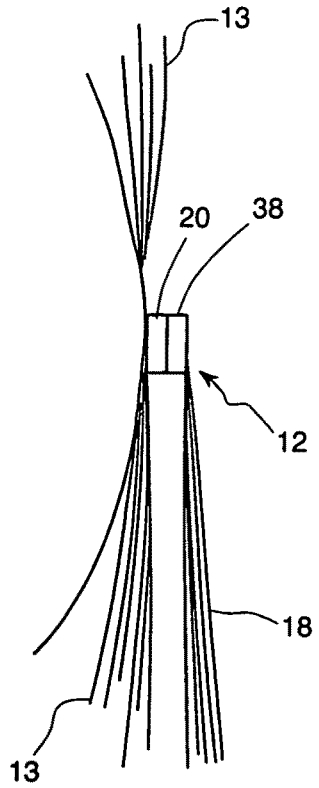
FIG. 11 shows an exaggerated alternative side view of the embodiments of FIG. 10.

FIG. 11 shows an alternative to the embodiments shown and disclosed in FIGS. 9,10. In FIG. 11 is shown an exaggerated view of a hair extension 12 best used on those individuals with thinning hair. In this embodiment, there is shown a first tape 20 affixed to a netted backing 38 which in turn is affixed to hair 18. This embodiment eliminates the use of second tape 22 which may become visible in user's with thinning hair especially those with thinning hair on top of the head. This method can also be beneficial for attaching hair extensions to the bang area of the head.

Figure 19:
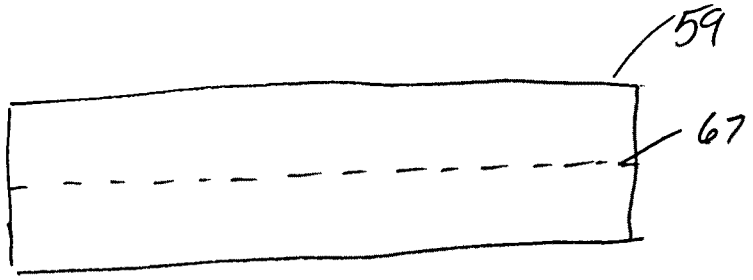
FIG. 19 shows an exaggerated view of another embodiment of tape on the weft or weftless.
Figure 20:
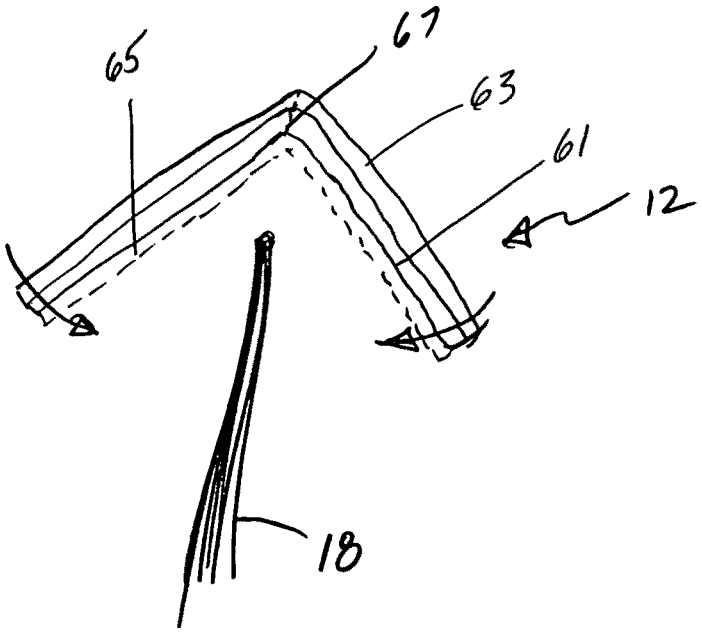
FIG. 20 shows an exaggerated view of the assembly of hair to the embodiment of tape shown in FIG. 19.

FIG. 19 shows another embodiment of tape, third tape 61. Third tape 61 has a third cover 63 on one side and fourth cover 65 on an opposite side and is generally a wider double sided tape.

This wider tape, third tape 61 can be scored in the center such that the user can remove fourth cover 65 (shown in hidden line) and fold third tape 61 along center 67 to affix third tape 61 to hair 18. The third cover 63 can then be removed and the hair extension 12 can be installed as has been previously disclosed.

Figure 12:
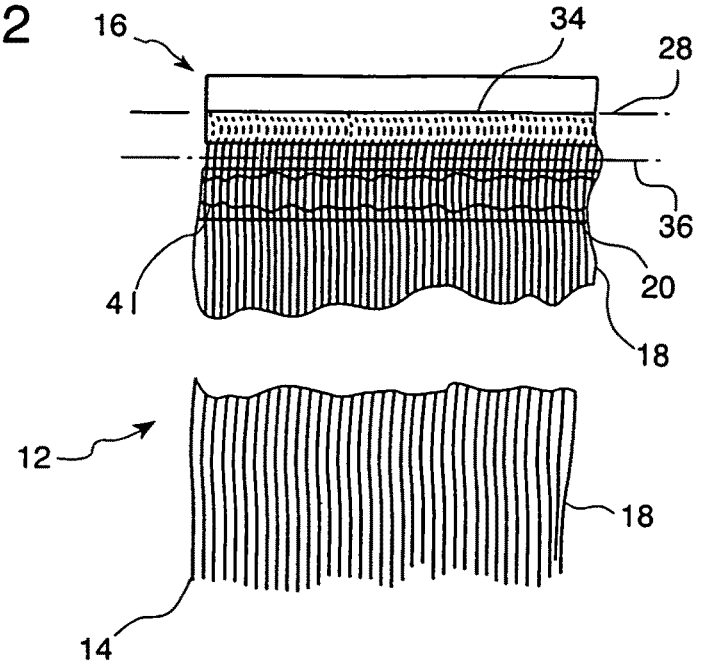
FIG. 12 shows an exaggerated front view of hair extensions that a user can use glue or adhesive to make the extension weft less.

FIG. 12 is an exaggerated view of a hair extension 12. These embodiments show one method of creating a weft less extension 12. To create a weft less extension, the user places a bead of adhesive 41 just below the fixed end 16 of the extension and allows the adhesive 41 to dry. The extension 12 is then flipped over and a second bead of adhesive 41 is applied to a corresponding location on the opposite side of the extension 12 and allowed to dry. A first tape 20 and second tape 22 is then applied over the adhesive 41, one tape on each side. The user can then cut the hair 18 along cut line 36 thus removing the weft 34 from the extension 12. The removal of the weft 34 allows the extension 12 to be used in thinning hair.

Figure 13:
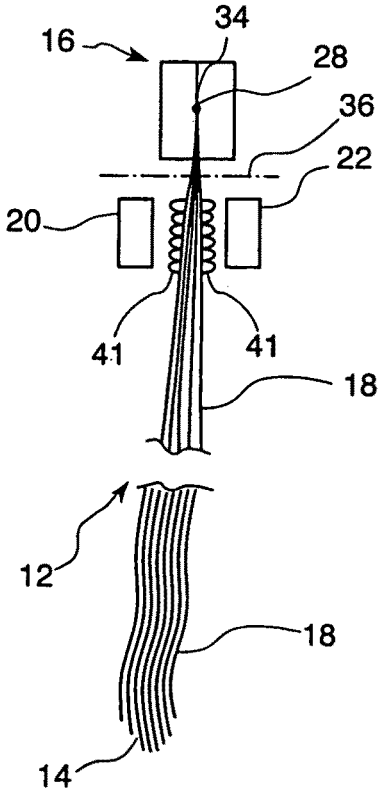
FIG. 13 shows an exaggerated side view of the embodiment shown in FIG. 12.
Figure 14:
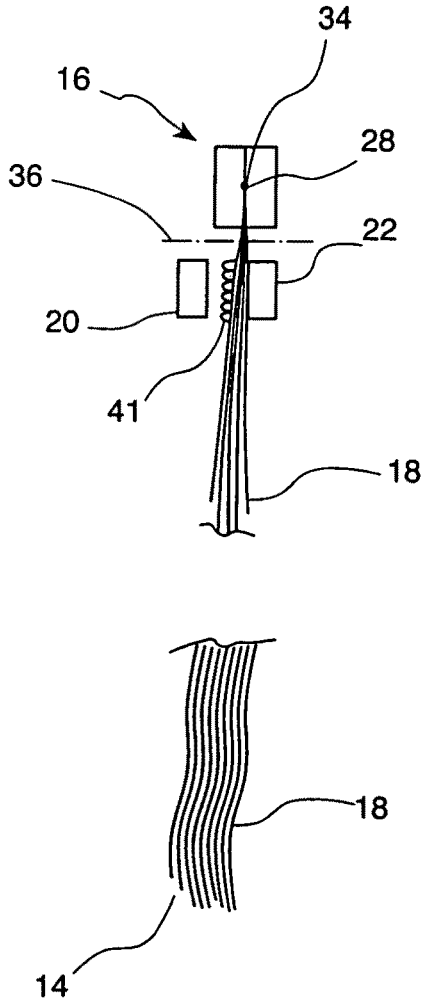
FIG. 14 shows an exaggerated side view of an alternative embodiment of FIG. 13 having one glue or adhesive application to make the extension weft less.

FIG. 14 shows an alternative embodiment to that shown in FIG. 13. FIG. 14 also shows the removal of the weft 34 from the extension 12, but in this embodiment, only one bead of adhesive 41 is used on one side of the hair 18. The first tape 20 and second tape 22 are still used as has been previously described to affix the extension 12 to the user's hair.

Figure 15:
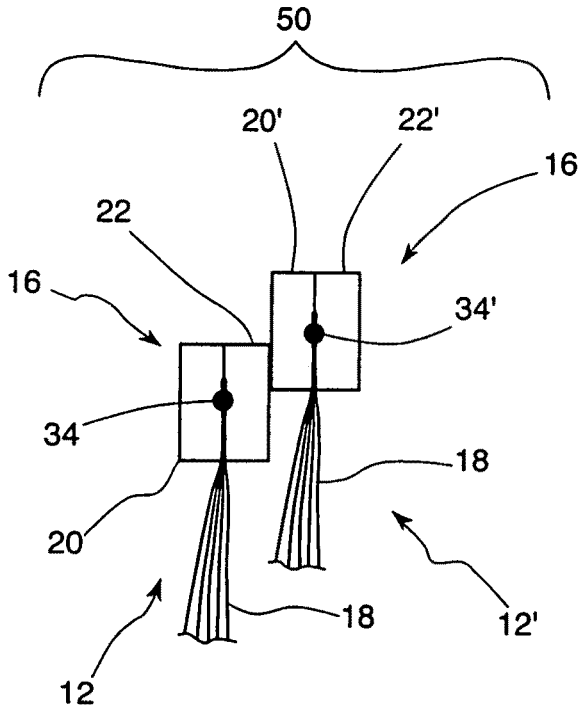
FIG. 15 shows an exaggerated side view of the fixed ends of two extensions combined.

FIG. 15 shows an exaggerated side view of two extensions creating a double extension 50. This double extension 50 may be used for users who have thicker hair or wish to greatly enhance their natural hair. FIG. 15 shows a first extension 12 attached to a second extension 12'. First extension 12 and second extension 12' may be coordinating colors or any color combination that a user may choose. To affix first extension 12 to second extension 12' requires the user to remove the second cover 26 (not shown) from second tape 22 and first cover 24' (not shown) from first tape 20'. The weft 34' of second extension 12' should be placed above the weft 34 of first extension 12 and the second tape 22 and first tape 20' secured to one another. This double extension 50 is then ready to be applied to a user's head as has been previously described.

The liquid PU used in these embodiments is a new form of attachment different than that used in the background art.

The background art polyurethane 'skin wefts' are mainstream in the hair extension market. They are known as 'seamless' in the industry. They are quite different from the embodiments disclosed herein as the embodiments disclosed herein are a brand new form of Liquid Polyurethane (PU) extension.

Background PU skin wefts are more dense, heavier, thicker, solid, and the hair is vented into the side of the polyurethane, creating hair on the front side of the extension and 'returns' on the back side of the extensions. The background art PU skin wefts, create a solid ridge in the hair which can be felt by the wearer, and by others who may feel the head of the wearer. They also add more weight to the extension, which may cause more tension to the wearers natural hair, and in some cases may cause a condition called 'tension alopecia' or baldness in spots, caused by the weight and tension from the hair extension applied to the wearers natural hair.

The disclosed liquid PU extensions herein are extremely light weight, paper thin, soft and flexible. The embodiments disclosed are essentially weightless and when applied correctly, will create virtually no tension to the wearers natural hair. In addition, there are three different attachment methods applicable to the present embodiments of liquid PU, to lessen the possibility of damage to the natural hair of the wearer. Because the present embodiments are paper thin, soft, flexible, and extremely comfortable, they can barely be felt by the wearer or by others. This is a major breakthrough in the hair extension industry.

In the present embodiments, the hair is attached directly into the liquid PU attachment, and therefor has no 'returns' on the back side of the attachment as does the background art.

One major problem with background art hair extensions is that they can be clearly felt by the wearer, and by others who may feel the wears hair. One may feel: ridges, lumps, bumps, plastic or metal nubs, thick tracks, or comb clips in the hair. The weight of these background art extensions and the application methods employed by these various types of background art systems, causes them to be less esthetically desirable and much more damaging to the wearers natural hair.

Background art skin weft extensions come on long strips and need to be cut to fit each application. The present embodiments come packaged in 3" wide or 1½" wide strips, pre-taped, stacked one above the other, and attached to both sides of a plastic card. The card can have a notch at the top to hang the card from a hook provided with the package. Each strip is simply peeled off the card, the liner is removed, and the extension is attached to the hair. Each card comes enclosed in a package which has complete application directions printed inside with corresponding photographs explaining the installation of these extensions.

The present embodiments disclose liquid PU extensions that are approximately ¼" high by 1½ to 3" wide, with rounded corners and no shine to moderate shine, with tape applied to one side. The hair in the present embodiments can be a solid color, highlighted colors, or piano stripe colors, and can be applied in any of these various color combinations.

Additional embodiments can include extensions ¼" to ½" high by 1½ to 3" wide with rounded corners, and have tapes applied to both sides of the extensions. Hair in these embodiments can likewise be a solid color, highlighted colors, piano stripe colors or 'reversible colors', or having one color on one side of the extensions and a different or corresponding color on the opposite side of the hair in the extensions as has been discussed prior.

Figure 21:
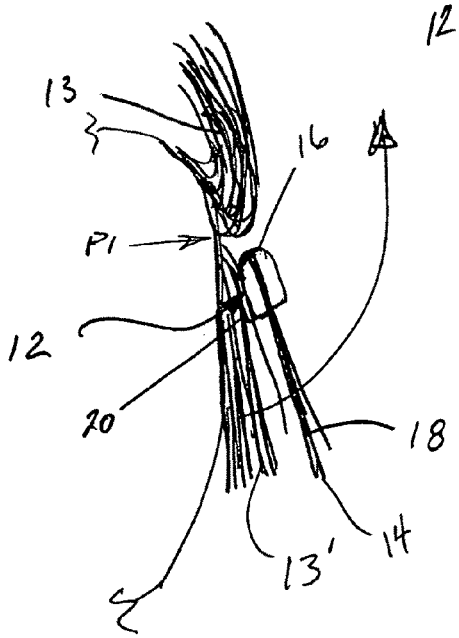
FIG. 21 show an exaggerated end view of another embodiment of hair extension attached to human hair.
Figure 22:
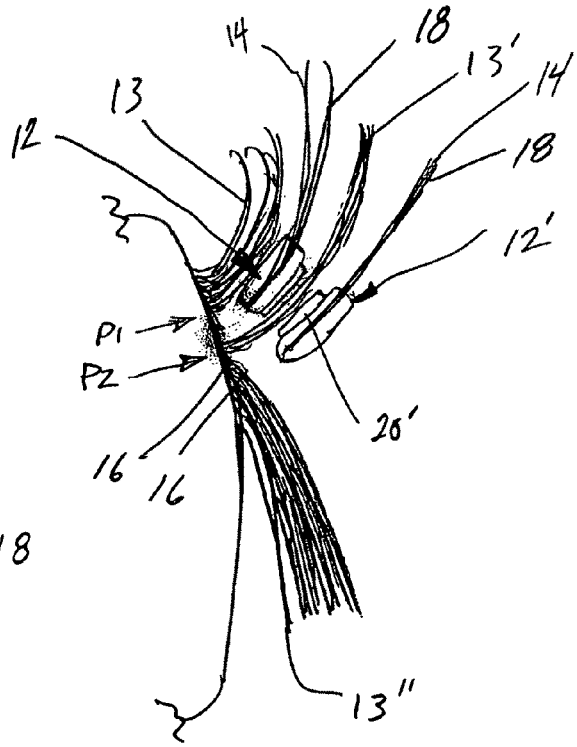
FIG. 22 shows an exaggerated end view of another embodiment of two hair extensions attached to human hair.

FIGS. 21 and 22 show another embodiment and attachment method for hair extensions 12 and 12'.

In FIG. 21, the hair 13 is parted at part P1 and lifted and retained. The first tape cover 24 (not shown) is removed and hair extension 12 is firmly pressed with first tape 20 below part P1 to natural hair 13'. Hair extension 12 and natural hair 13' is then lifted up forming part P2. Part P2 is the cleared of any stray natural hair 13 leaving a clean part P2. This allows hair extension 12' to be adhered with first tape 20' to natural hair 13' and aligned end to end with hair extension 12. The two extensions 12 and 12' are then pressed together firmly. The hair extensions 12 and 12' and natural hair 13, 13' and hair 18 is then lowered providing a sandwich like attachment of extensions 12 and 12'.

These embodiments can likewise have the polymer or liquid PU 55 and first tapes 20, 20' colored to match or coordinate with the hair 18 of the extensions 12 and 12'. Likewise, the corners of the fixed end 16 can have rounded corners 57 to lessen the chance of feeling the extension 12 or 12' when installed. The liquid PU 55 can be manufactured having no shine to moderate shine to hide better in the users natural hair 13 and 13'.

It should be understood that the converse to the method of hair extensions installation disclosed in FIGS. 21, 22 is also anticipated. This method could be reversed wherein extension 12 is installed as has been discussed and instead of pulling extension 12 up, the natural hair 13 above the installed extensions 12 is lowered and a part (not shown) made above natural hair 13 wherein extension 12' is affixed in the manner shown in FIG. 22 on top of extension 12 creating the dual extension 12, 12' sandwich method of installation.

Figure 23:
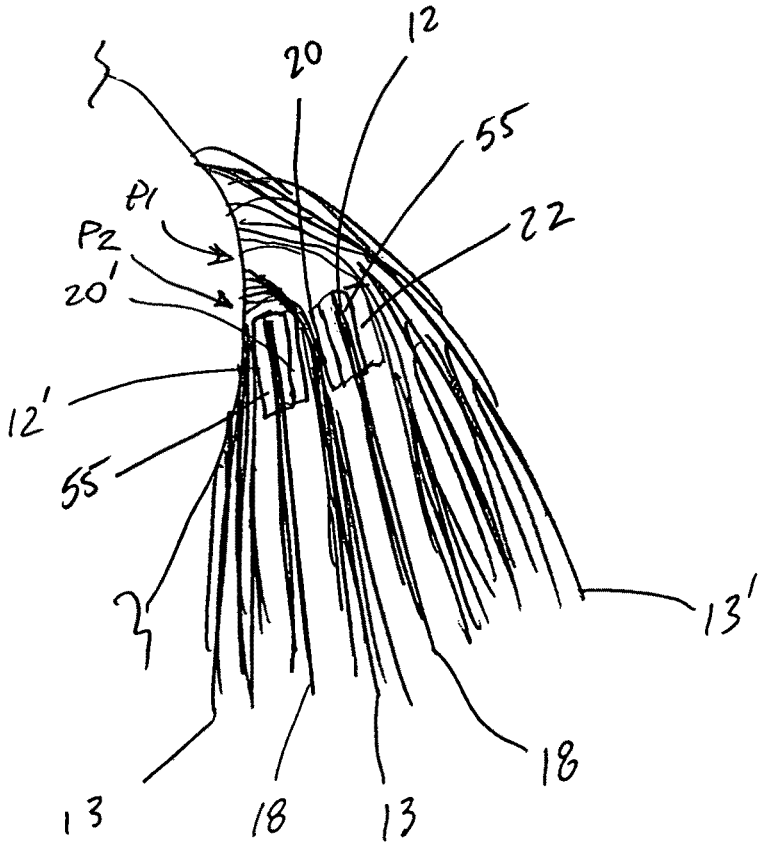
FIG. 23 shows an exaggerated end view of another embodiment of two hair extensions attached to human hair.

Another embodiment is shown in FIG. 23. FIG. 23 shows two hair extensions 12, 12' attached to users natural hair 13, 13'. In this embodiment, a part P1 is made and the first cover 24 (not shown) is peeled from first tape 20 and hair extension 12 is attached to the users natural hair 13. Extension 12 and hair 13' is then lifted to form part P2. P2 is then cleared of any hair 13' leaving a clean part P2 creating a good surface for the attachment of hair extension 12'. Extension 12' is installed end to end matching hair extension 12 with natural hair 13 between the first tapes 20 and 20'. Extension 12 and 12' are pressed together firmly.

First part P1 is made again and second tape 24 with cover 26 is secured to extension 12. Second cover 26 (not shown) is peeled off and hair 13' is allowed to drop onto second tape 22 where it is pressed firmly to second tape 22 and secured.

This embodiment uses two extensions 12' and 12 and hair extension 12 uses two tapes 20, 22 to secure it to hair extension 12' and natural hair 13 and 13'. This embodiment essentially has one extension with tape on one side and a second extension with tapes on two sides.

It should be understood that hair extensions 12 and 12' can be removed and the tapes 20, 22 and 20' can be replaced. This allows the extensions 12 and 12' to be removed and re-applied. These replacement tapes 20, 22 and 20' likewise can be color matching to the polymer 55 or liquid PU and the hair 18 or the replacement tapes 20, 22 and 20' may be clear and can be provided in rolls. As has been previously discussed, these extensions 12 disclosed herein can have a single color hair 18, or the hair 18 may be multi colored, piano stripe colors, highlighted or have one color on one side and another color on the other side or a blended color of the hair 18.

These embodiments can have a height of approximately ¼" to ½" with width of approximately 1.5" to 3".

Figure 16:
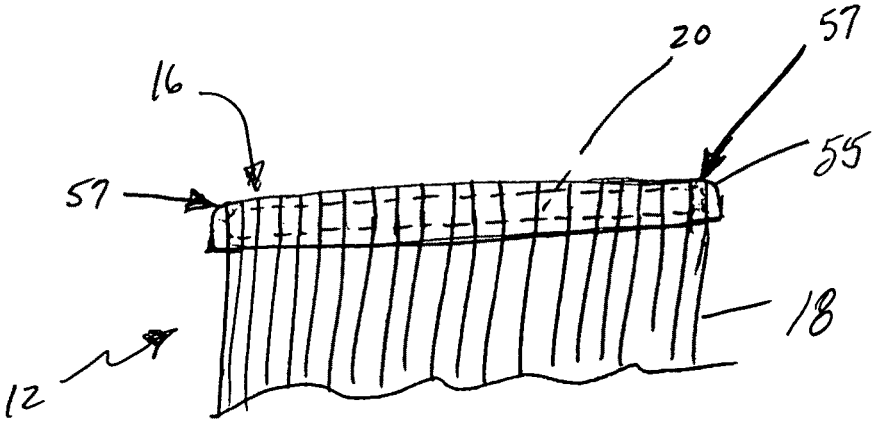
FIG. 16 shows an exaggerated front view of another embodiment using a polymer such as liquid polyurethane or liquid PU to hold the hair in the hair extension with a single piece of tape for bonding to the users head.

FIG. 16 shows an exaggerated front view of another embodiment of the hair extension 12. In this embodiment, the hair 18 is fixed into a receiver (not shown) and a polymer 55, by way of example only, liquid polyurethane or liquid PU, is poured onto the hair 18 retaining the hair in the polymer 55 for attachment to the user. This embodiment of hair extension 12 has rounded corners 57 on each of the ends of the fixed end 16. The polymer 55 and first tape 20 can match the color of the hair 18 or can be clear. This embodiment of hair extension 12 uses a single tape first tape 20 and first cover 24. One preferred the width of this hair extension 12 is approximately 1.5"-3" and having a height of approximately ¼" with no shine to moderate shine on the surface of the liquid PU or polymer 55. The low shine or no shine liquid PU or polymer 55 can help hide the extensions 12 in the users natural hair 13. The second tape 22 can be added to the extension 12 once it has been attached to the natural hair 13. Second tape 22 is applied to the polymer 55 or liquid PU, second cover 26 is removed and the natural hair 13 is dropped and secured to second tape 22 and pressed together firmly.

Separate tapes or additional tapes can be provided with this embodiment and the others disclosed in this application. These supplemental tapes can be used to enhance the securement of single extension 12 to the user. These supplemental tapes can also be used if the extensions 12 are removed and then re-attached.

Figure 17:
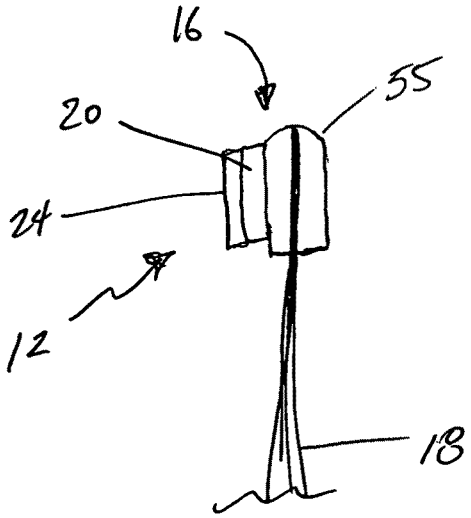
FIG. 17 shows an exaggerated end view of the embodiments shown in FIG. 16.

FIG. 17 shows an exaggerated end view of the embodiments in FIG. 16. It can be seen that the hair 18 is retained within polymer 55, to which is attached first tape 20 with first cover 24 or liner. The first cover 24 is removed and the first tape 20 is used to attach the hair extension 12 to the user's natural hair as has been previously described. The polymer 55 is relatively soft, paper thin, pliable and has rounded corners 57 so that the wearer can barely feel or not feel at all the hair extension 12 when attached. The polymer 55 is also exposed on front and back sides of the hair 18 as illustrated in FIGS. 16 and 17. The height of this embodiment can be approximately ¼". This attachment 12 is and feels completely seamless and has been designed so that the wearer will not feel the attachment in their head. It is lighter and causes less stress to the natural hair 13 and no one will feel the extension being worn as it feels like nothing at all is in the natural hair 13.

Second tape 22 with second cover 26 could be added to the polymer 55 or liquid PU to the side opposite first tape 20 and first cover 24 as has been described above, not shown.

Figure 18:
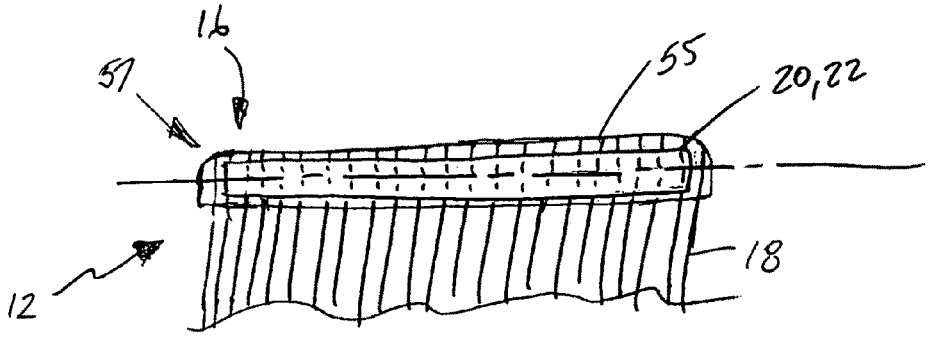
FIG. 18 shows an exaggerated alternative embodiment of the hair extension with rounded liquid PU corners.

FIG. 18 shows an alternative embodiment of hair extension 12 with rounded corners 57 and weftless hair 18. These rounded corners 57 lessen the chances of snagging hair implements or the user feeling the hair extensions 12 when installed. Obviously, rounded corners can be used with the other embodiments disclosed in this application. In this embodiment the polymer 55 or liquid PU and tapes 20,22 can be colored the same or corresponding color to the hair 18. This extension 12 can be attached to the natural hair 13 with the first tape 20 as has been previously described. The second cover 26 from the second tape 22 can then be removed and the natural hair 13 above the part can be lowered and affixed to second tape 22. This embodiment likewise can be manufactured with a height of approximately ¼" to ½" with width of approximately 1.5" to 3".

This embodiment of hair extensions 12 is extremely thin, has no weft and rounded corners. As a result, this hair extension 12 embodiment is soft, pliable and there is virtually no shedding from the extension 12.

Figure 24:
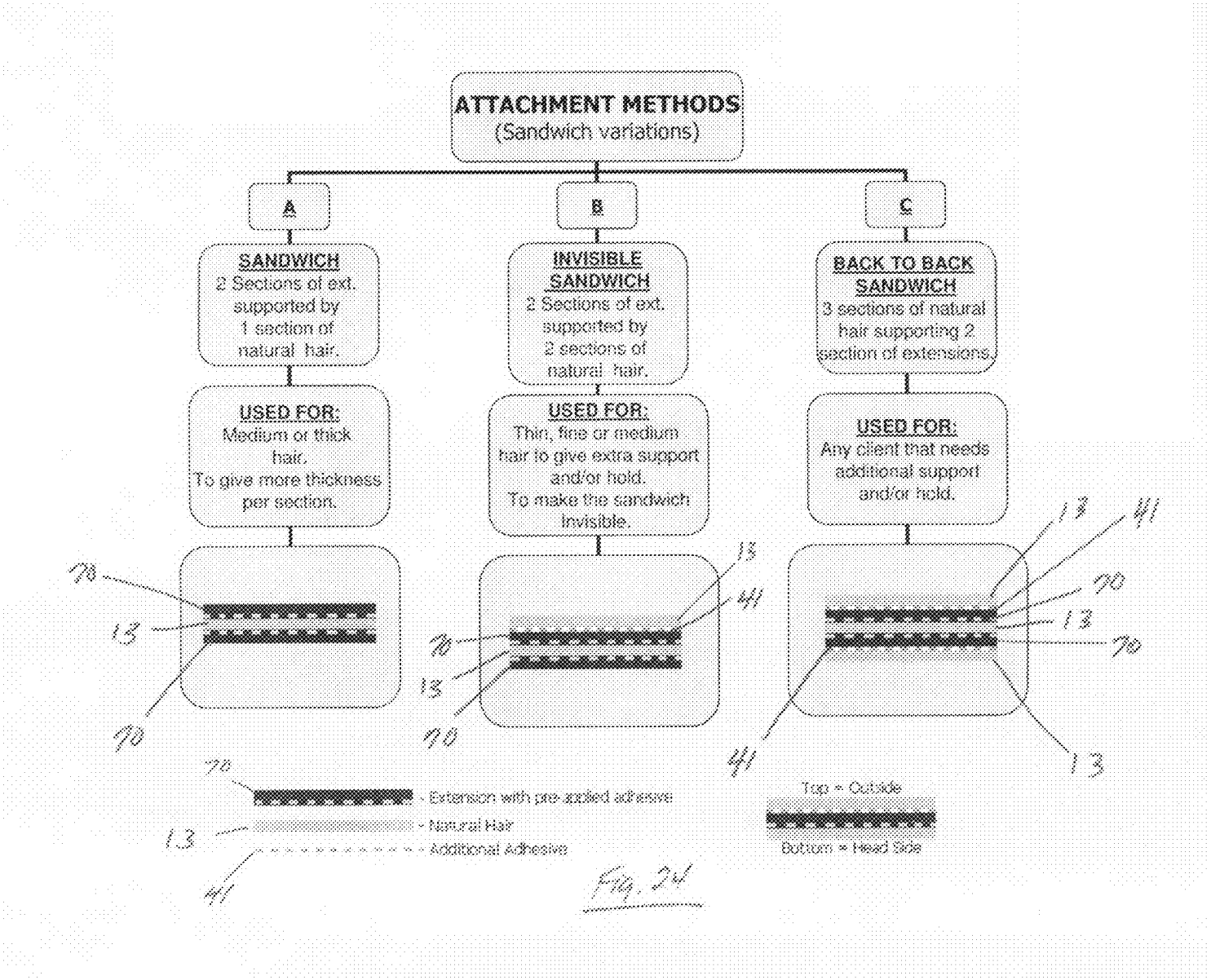
FIG. 24 shows a flow chart of various methods of applying extensions to different types of hair.

FIG. 24 shows various methods for attaching hair extensions 70 to a users head. FIG. 24 specifically shows variations of the "sandwich" method. Three variations are shown in FIG. 24. The first or A method can be used for persons having medium or thick hair. In this method two extensions 70 having pre-applied adhesive on one side of each extension are affixed to the users natural hair 13. In essence sandwiching the users natural hair 13.

The B method can be used on thin, fine or medium natural hair and utilizes two extensions 70 with pre-applied adhesive. This method can also be beneficial for use where the hair parts, near a cow lick or with shorter layered hair. The natural hair 13 is sandwiched in between with the addition of adhesive 41 on the second side of one extension 70 for adhering to another section fo the users natural hair 13.

The C method can be used for users that need additional support or hold and involve two extensions 70 with pre-applied adhesive on a first side. The addition of adhesive 41 to the second side of each extension 70 is used for affixing additional sections of the users natural hair 13. This essentially sandwiches the users natural hair 13 between two extensions 70 with pre-applied adhesive on a first side of the extension and additional adhesive 41 applied to the second side of each extension 70.

Figure 25:
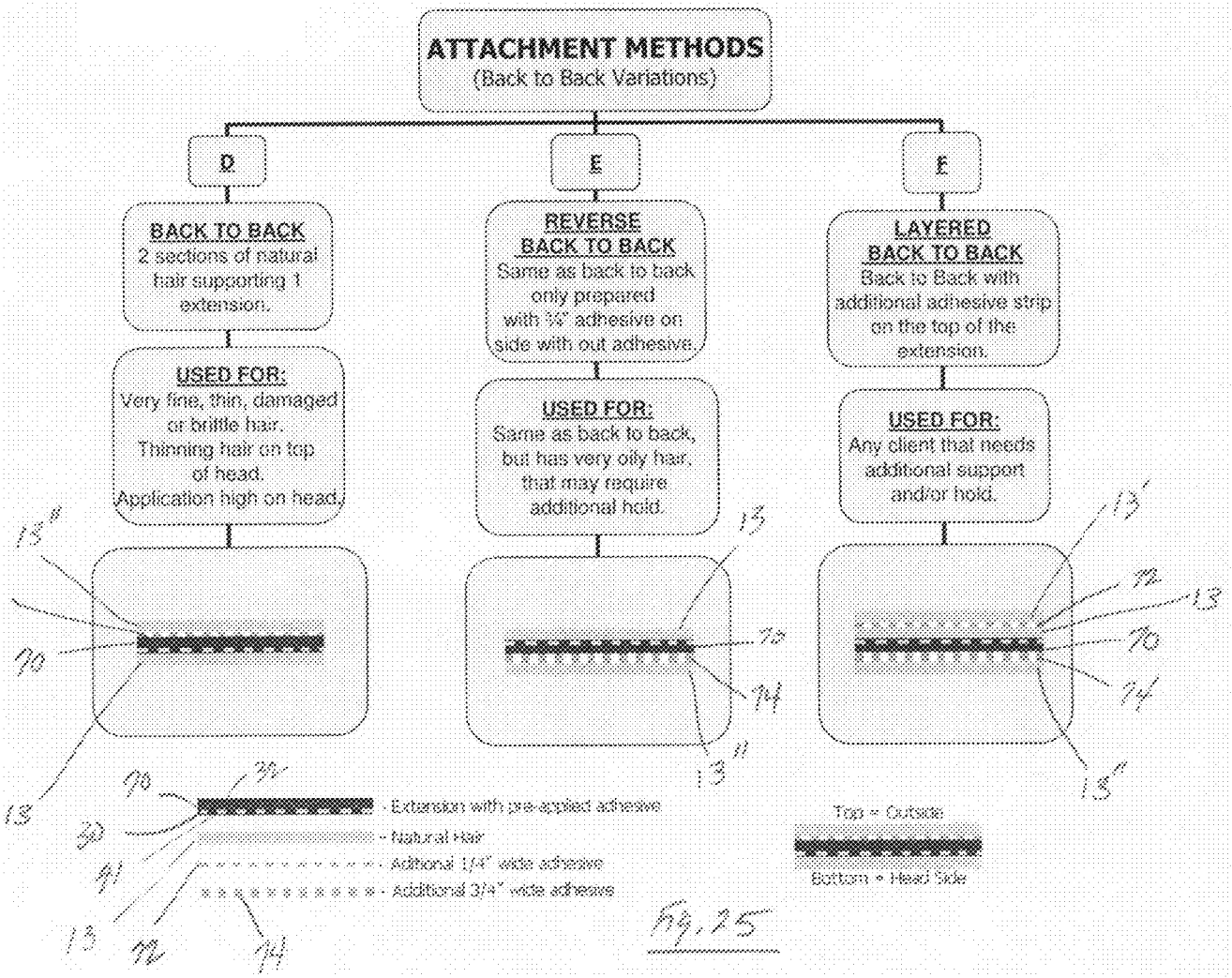
FIG. 25 shows a flow chart of various methods of applying extensions to different types of hair.

FIG. 25 shows another flow chart showing various methods of hair attachment that can be used for various permutations of desired hair and hair types. FIG. 25 shows a variation to the methods shown in FIG. 24.

The methods shown use a single extension 70 with adhesive pre-applied to a first side 30 with the addition of either a narrow adhesive 72 or a wide adhesive 74 applied to the second side 32.

The D method shows an extension 70 and natural hair 13 attached to the first side 30 of extension 70. The second side 32 of extension 70 has a narrow adhesive 72 applied and then a second piece of natural hair 13". This method can be used for users who have very fine, thin damaged, brittle hair or for application high on the users head.

Method E can be used for a wide variety of hair but is specially beneficial to hose having very oily hair that may benefit with the additional hold of the wide adhesive 74.

The extension 70 first side 30 is affixed to the users natural hair 13 and a wide adhesive 74 is attached to the second side 32 of extension 70 where a second strip of natural hair 13" is then attached.

Method F can be applied to users who require additional support or hold. Method F is applied where the natural hair 13 is affixed to the pre-applied adhesive on the first side 30 of extension 70. The other side of this natural hair 13 is applied a narrow adhesive 72 and an additional strip of natural hair 13' is then applied to the other side of a narrow adhesive 72.

The second side 32 of extension 70 has a wide adhesive 74 applied to which another strip of natural hair 13" is affixed.

Applicant's thereby provide a method for determining each individual users needs based on the hair type and application location in the users head. Applicants also provide solutions for placement of extensions 70 on and in the users natural hair.

It will now be apparent to those skilled in the art that other embodiments, improvements, details and uses can be made consistent with the letter and spirit of the foregoing disclosure and within the scope of this disclosure, construed in accordance with the patent law, including the doctrine of equivalents.

What is claimed is:

1. A method for attaching hair extensions to natural hair of a user, the method comprising:

horizontally parting natural hair of the user to form a part;

attaching a first hair extension to natural hair of the user below the part, wherein the first hair extension includes a first section of hair and a first adhesive tape, wherein the first section of hair is affixed together at one end by a first solidified liquid polymer that is soft, paper thin, pliable, and has rounded corners to reduce a likelihood that the user will feel the first hair extension when the first hair extension is attached to natural hair of the user, wherein a first side of the first adhesive tape is attached to the first polymer on a first side of the first section of hair, and wherein a second side of the first adhesive tape is used to attach the first hair extension to natural hair of the user;

lifting the first hair extension after attachment of the first hair extension to natural hair of the user; and attaching a second hair extension to natural hair of the user such that the first hair extension and the second hair extension are aligned end to end and natural hair of the user is sandwiched between the first hair extension and the second hair extension, wherein the second hair extension includes a second section of hair and a second adhesive tape, wherein the second section of hair is affixed together at one end by a second solidified liquid polymer that is soft, paper thin, pliable, and has rounded corners to reduce a likelihood that the user will feel the second hair extension when the second hair extension is attached to natural hair of the user, wherein a first side of the second adhesive tape is attached to the second polymer on a first side of the second section of hair, and wherein a second side of the second adhesive tape is used to attach the second hair extension to natural hair of the user.

2. The method of claim 1, further comprising:

applying an adhesive to the first polymer on a second side of the first section of hair, wherein the second side of the first section of hair is opposite the first side of the first section of hair; and securing natural hair of the user from above the part to the adhesive.

3. The method of claim 2, wherein:

the adhesive is a third adhesive tape having a first side and a second side;

applying the adhesive to the first polymer includes attaching the first side of the third adhesive tape to the first polymer on the second side of the first section of hair; and securing natural hair of the user from above the part to the adhesive includes securing natural hair of the user from above the part to the second side of the third adhesive tape.

4. The method of claim 2, further comprising:

applying another adhesive to the second polymer on a second side of the second section hair, wherein the second side of the second section of hair is opposite the first side of the second section of hair; and attaching the other adhesive to natural hair of the user below the second hair extension so as to sandwich the first hair extension and the second hair extension between natural hair of the user.

5. The method of claim 4, wherein:

the other adhesive is a third adhesive tape having a first side and a second side;

applying the other adhesive to the second polymer includes attaching the first side of the third adhesive tape to the second polymer on the second side of the second section of hair; and attaching the other adhesive to natural hair of the user includes attaching the second side of the third adhesive tape to natural hair of the user below the second hair extension so as to sandwich the first hair extension and the second hair extension between natural hair of the user.

6. The method of claim 2, further comprising:

determining a hair type for the user;

wherein the steps of applying the adhesive to the first polymer on the second side of the first section of hair and securing natural hair of the user from above the part to the adhesive are performed when the hair type is determined to be a first hair type.

7. A method for attaching hair extensions to natural hair of a user, the method comprising:

horizontally parting natural hair of the user to form a part;

attaching a hair extension to natural hair of the user below the part, wherein the hair extension includes a section of hair and a first adhesive tape, wherein the section of hair is affixed together at one end by a solidified liquid polymer that is soft, paper thin, pliable, and has rounded corners to reduce a likelihood that the user will feel the hair extension when the hair extension is attached to natural hair of the user, wherein a first side of the first adhesive tape is attached to the polymer on a first side of the section of hair, and wherein a second side of the first adhesive tape is used to attach the hair extension to natural hair of the user;

attaching a first side of a second adhesive tape to the polymer on a second side of the section of hair;

securing natural hair of the user from above the part to a second side of the second adhesive tape; and attaching a third adhesive tape to natural hair of the user that is secured to the second side of the second adhesive tape such that the third adhesive tape is positioned above the second adhesive tape and natural hair of the user is secured between the third adhesive tape and the second side of the second adhesive tape.

8. The method of claim 7, wherein the second adhesive tape has a width of ¼ to ½ inches.

9. The method of claim 7, wherein the second adhesive tape has a width of ¾ inches.

10. The method of claim 7, wherein the third adhesive tape has a width of ¼ to ½ inches.

11. A method for attaching hair extensions to natural hair of a user, the method comprising:

determining a hair type for natural hair of the user;

horizontally parting natural hair of the user to form a part;

when the hair type is determined to be a first hair type, attaching a first hair extension to natural hair of the user below the part, wherein the first hair extension includes a first section of hair and a first adhesive tape, wherein the first section of hair is affixed together at one end by a first solidified liquid polymer that is soft, paper thin, pliable, and has rounded corners to reduce a likelihood that the user will feel the first hair extension when the first hair extension is attached to natural hair of the user, wherein a first side of the first adhesive tape is attached to the first polymer on a first side of the first section of hair, and wherein a second side of the first adhesive tape is used to attach the first hair extension to natural hair of the user;

lifting the first hair extension after attachment of the first hair extension to natural hair of the user; and attaching a second hair extension to natural hair of the user such that the first hair extension and the second hair extension are aligned end to end and natural hair of the user is sandwiched between the first hair extension and the second hair extension, wherein the second hair extension includes a second section of hair and a second adhesive tape, wherein the second section of hair is affixed together at one end by a second solidified liquid polymer that is soft, paper thin, pliable, and has rounded corners to reduce a likelihood that the user will feel the second hair extension when the second hair extension is attached to natural hair of the user, wherein a first side of the second adhesive tape is attached to the second polymer on a first side of the second section of hair, and wherein a second side of the second adhesive tape is used to attach the second hair extension to natural hair of the user;

when the hair type is determined to be a second hair type that requires more support than the first hair type, attaching the first hair extension to natural hair of the user below the part;

lifting the first hair extension after attachment of the first hair extension to natural hair of the user;

attaching the second hair extension to natural hair of the user such that the first hair extension and the second hair extension are aligned end to end and natural hair of the user is sandwiched between the first hair extension and the second hair extension;

attaching a first side of a third adhesive tape to the first polymer on a second side of the first section of hair; and securing natural hair of the user from above the part to a second side of the third adhesive tape.

12. The method of claim 11, further comprising:

when the hair type is determined to be a third hair type that requires more support than the second hair type, attaching the first hair extension to natural hair of the user below the part;

lifting the first hair extension after attachment of the first hair extension to natural hair of the user;

attaching the second hair extension to natural hair of the user such that the first hair extension and the second hair extension are aligned end to end and natural hair of the user is sandwiched between the first hair extension and the second hair extension;

attaching the first side of the third adhesive tape to the first polymer on the second side of the first section of hair;

securing natural hair of the user from above the part to the second side of the third adhesive tape;

attaching a first side of a fourth adhesive tape to the second polymer on a second side of the second section of hair; and attaching a second side of the fourth adhesive tape to natural hair of the user below the second hair extension so as to sandwich the first hair extension and the second hair extension between natural hair of the user.

13. The method of claim 11, wherein the first hair type is thick or medium hair, and wherein the second hair type is thin or fine hair.

14. A method for attaching hair extensions to natural hair of a user, the method comprising:

determining a hair type for natural hair of the user;

horizontally parting natural hair of the user to form a part;

when the hair type is determined to be a first hair type, attaching a hair extension to natural hair of the user below the part, wherein the hair extension includes a section of hair and a first adhesive tape, wherein the section of hair is affixed together at one end by a solidified liquid polymer that is soft, paper thin, pliable, and has rounded corners to reduce a likelihood that the user will feel the hair extension when the hair extension is attached to natural hair of the user, wherein a first side of the first adhesive tape is attached to the polymer on a first side of the section of hair, and wherein a second side of the first adhesive tape is used to attach the hair extension to natural hair of the user;

attaching a first side of a second adhesive tape to the polymer on a second side of the section of hair; and securing natural hair of the user from above the part to a second side of the second adhesive tape;

when the hair type is determined to be a second hair type that requires more support than the first hair type, attaching the hair extension to natural hair of the user below the part;

attaching a first side of a third adhesive tape to the polymer on the second side of the section of hair, wherein the third adhesive tape is wider than the second adhesive tape; and securing natural hair of the user from above the part to a second side of the third adhesive tape.

15. The method of claim 14, further comprising:

when the hair type is determined to be a third hair type that requires more support than the second hair type, attaching the hair extension to natural hair of the user below the part;

attaching the first side of the second adhesive tape to the polymer on the second side of the section of hair;

securing natural hair of the user from above the part to the second side of the second adhesive tape; and attaching a third adhesive tape to natural hair of the user that is secured to the second side of the second adhesive tape such that the third adhesive tape is positioned above the second adhesive tape and natural hair of the user is secured between the third adhesive tape and the second side of the second adhesive tape.

16. The method of claim 14, wherein the first hair type is very fine, thin, damaged or brittle hair and wherein the second hair type is oily hair.

17. A method for attaching hair extensions to natural hair of a user, the method comprising:

providing a pair of hair extensions, wherein each hair extension of the pair of hair extensions includes a section of hair and an adhesive attached to one side of the section of hair;

attaching the adhesive of a first hair extension of the pair of hair extensions to a section of natural hair of the user; and attaching the adhesive of a second hair extension of the pair of hair extensions to the section of natural hair of the user such that the first hair extension and the second hair extension are aligned end to end widthwise and the section of natural hair of the user is sandwiched between the first hair extension and the second hair extension.

18. The method of claim 17, wherein the adhesive of each hair extension is double-sided adhesive tape.

19. The method of claim 17, wherein the first hair extension is attached to the section of natural hair of the user below a part in the natural hair of the user, the method further comprising:

securing natural hair of the user from above the part to the first hair extension using a second adhesive.

20. The method of claim 19, wherein the first hair extension further includes a double-sided adhesive tape attached to an opposite side of the section of hair, and wherein the second adhesive is the double-sided adhesive tape.

21. The method of claim 19, wherein securing natural hair of the user from above the part to the first hair extension using an adhesive comprises:

attaching a first side of a double-sided adhesive tape to an opposite side of the section of hair of the first hair extension; and lowering natural hair of the user from above the part onto a second side of the double-sided adhesive tape.

* * * * *